US009618010B2

(12) United States Patent
Sahu et al.

(10) Patent No.: US 9,618,010 B2
(45) Date of Patent: Apr. 11, 2017

(54) FAN SYSTEMS

(71) Applicant: Lennox Industries Inc., Richardson, TX (US)

(72) Inventors: Kapil Das Sahu, Chennai (IN); Robert B. "Dutch" Uselton, Plano, TX (US)

(73) Assignee: Lennox Industries Inc., Richardson, TX (US)

( * ) Notice: Subject to any disclaimer, the term of this patent is extended or adjusted under 35 U.S.C. 154(b) by 855 days.

(21) Appl. No.: 13/867,461

(22) Filed: Apr. 22, 2013

(65) Prior Publication Data

US 2014/0314562 A1 Oct. 23, 2014

(51) Int. Cl.
*F04D 29/54* (2006.01)
*F04D 19/00* (2006.01)
*F04D 29/52* (2006.01)

(52) U.S. Cl.
CPC ..... *F04D 29/547* (2013.01); *F04D 19/002* (2013.01); *F04D 29/526* (2013.01)

(58) Field of Classification Search
CPC .... F04D 29/403; F04D 29/526; F04D 29/545; F04D 29/547; F04D 29/384; F05D 2240/307; F05D 2250/323; F05D 2250/324
See application file for complete search history.

(56) References Cited

U.S. PATENT DOCUMENTS 5,248,224 A * 9/1993 Amr ..... F04D 29/547 415/220
6,499,948 B1 * 12/2002 Iyer ..... F04D 29/545 415/220

FOREIGN PATENT DOCUMENTS

EP 0490308 A1 6/1992
EP 0645543 A1 3/1995

OTHER PUBLICATIONS

European Search Report for related EP Application No. 14275086.8, Sep. 19, 2014, 8 pages, European Patent Office.

* cited by examiner

*Primary Examiner* — Eric Keasel
*Assistant Examiner* — Cameron Corday
(74) *Attorney, Agent, or Firm* — Bell Nunnally & Martin LLP; Craig J. Cox

(57) ABSTRACT

A fan system may generate an air flow during use. In various implementations, a fan system may include a fan and an orifice. The orifice may include a converging section, a diverging section, and a minimum radius section disposed between the converging section and the diverging section.

16 Claims, 4 Drawing Sheets

FAN SYSTEMS

TECHNICAL FIELD

The present disclosure relates to fans.

BACKGROUND

Fans are utilized in a wide variety of operations. For example, fans may be utilized in heat pumps, in air conditioning systems, and/or in refrigeration systems. The types of fans utilized in such systems may include mechanical fans, such as axial flow fans and/or cross-flow fans. The fan type and/or size may be selected based on the desired use of the fan.

SUMMARY

In various implementations, a fan system may include an orifice and a fan. The orifice may include an inner surface. The inner surface may include a converging section, a diverging section, and a minimum radius section disposed between the converging section and the diverging section. The fan may be disposed at least partially in the fan orifice. The fan may include a top tip and a bottom tip and have a fan diameter. The fan may include a minimum clearance that includes a first distance along a x-axis between a portion of the minimum radius section of the inner surface of the orifice and the top tip of the fan, and the minimum clearance may be approximately 0.0075 times the fan diameter to approximately 0.0125 times the fan diameter. The fan may include a maximum clearance that includes a second distance along a x-axis between a portion of the converging section of the inner surface of the orifice and the bottom tip of the fan, and the maximum clearance is approximately 0.04 times the fan diameter to approximately 0.05 times the fan diameter.

Implementations may include one or more of the following features. The orifice may include an outer surface with an approximately similar shape to the inner surface. A distance along a y-axis between the top tip of the fan and the minimum radius section may be approximately 0 to approximately 0.3 times the fan height. A distance along a y-axis between the top tip of the fan and a bottom of the orifice may be approximately 0.85 times the fan height to approximately 0.95 times the fan height. A distance along a y-axis between the top tip of the fan and a bottom of the orifice may be approximately 0.85 times the fan height to approximately 0.95 times the fan height. At least a portion of the diverging section of the orifice may slope, and at least a portion of the converging section of the orifice may slope.

In various implementations, a fan system may include an orifice and a fan. The orifice may include an inner surface, which includes a converging section disposed proximate a bottom of the orifice, a diverging section, and a minimum radius section disposed between the converging section and the diverging section. The minimum radius section may include a minimum diameter point. The fan may include a top tip and a bottom tip. The fan height may be the distance between the top tip and the bottom tip. The fan may be disposed in the orifice such that a distance along a y-axis between the top tip of the fan and the minimum diameter point is approximately 0 to approximately 0.3 times the fan height.

Implementations may include one or more of the following features. The fan may be disposed in the orifice such that the top tip is approximately 0.85 times the fan height to approximately 0.95 times the fan height from the bottom of the orifice along the y-axis. The orifice may include an outer surface, and at least a portion of the outer surface may have an approximately similar shape to at least a portion of the inner surface. A minimum clearance of the fan system may be a distance along the x-axis between at least a portion of the minimum radius section of the inner surface of the orifice and the top tip of the fan. The minimum clearance may be approximately 0.0075 times a fan diameter to approximately 0.0125 times the fan diameter. The fan system may include a maximum clearance that may be a distance along the x-axis between at least a portion of the converging section of the inner surface of the orifice and the bottom tip of the fan. The maximum clearance may be approximately 0.04 times a fan diameter to approximately 0.05 times the fan diameter.

In various implementations, a fan system may include an orifice and a fan. The orifice may include an inner surface, which includes a converging section, a diverging section, and a minimum radius section disposed between the converging section and the diverging section. The fan may be disposed in the fan orifice such that a first clearance between a top tip of the fan and a first part of the inner surface of the orifice is less than a second clearance between a bottom tip of the fan and a second part of the inner surface of the orifice.

Implementations may include one or more of the following features. A minimum clearance of the fan system may be a distance along an x-axis between at least a portion of the minimum radius section of the inner surface of the orifice and the top tip of the fan. The minimum clearance may be approximately 0 to approximately 0.0125 times the fan diameter. The fan system may include a maximum clearance that may be a distance along an x-axis between at least a portion of the converging section of the inner surface of the orifice and the bottom tip of the fan. The maximum clearance may be approximately 0.04 times a fan diameter to approximately 0.05 times the fan diameter. The fan may be disposed in the orifice such that the top tip is approximately 0.85 times a fan height to approximately 0.95 times the fan height from a bottom of the orifice along a y-axis. The converging section of the orifice may include a first end proximate a bottom of the orifice and a second end proximate the minimum radius section. In some implementations, the first end may be approximately 0.04 times a fan diameter to approximately 0.05 times the fan diameter from the bottom tip of the fan along an x-axis. In some implementations, the top tip of the fan may be approximately 0 to approximately 0.3 times the fan height along the y-axis from a minimum diameter point of the minimum radius section of the inner surface of the orifice. The converging section may slope from the first end to the second end. At least a portion of the converging section may include linearly sloped part, and at least a portion of the diverging section may include a linearly sloped part. In some implementations, a radius of the orifice proximate a top end of the orifice may be less than a radius of the orifice proximate a bottom end of the orifice. The fan orifice may include an approximately circular cross-section.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

In various implementations, fan systems are utilized to provide a fluid flow (e.g., air flow) in a variety of applications, such as air conditioning and/or refrigeration. For example, fan systems may be utilized with outdoor and/or indoor coils in air conditioning systems. The fan systems may be utilized with heat exchangers in refrigeration units.

Fan systems may include an orifice, a fan disposed at least partially within the orifice, and a motor that drives the fan. The motor may cause blades of the fan to rotate and cause movement of the air proximate the fan blades. Thus, the movement of the fan blades may generate an airflow through an opening in the orifice.

Figure 1A:
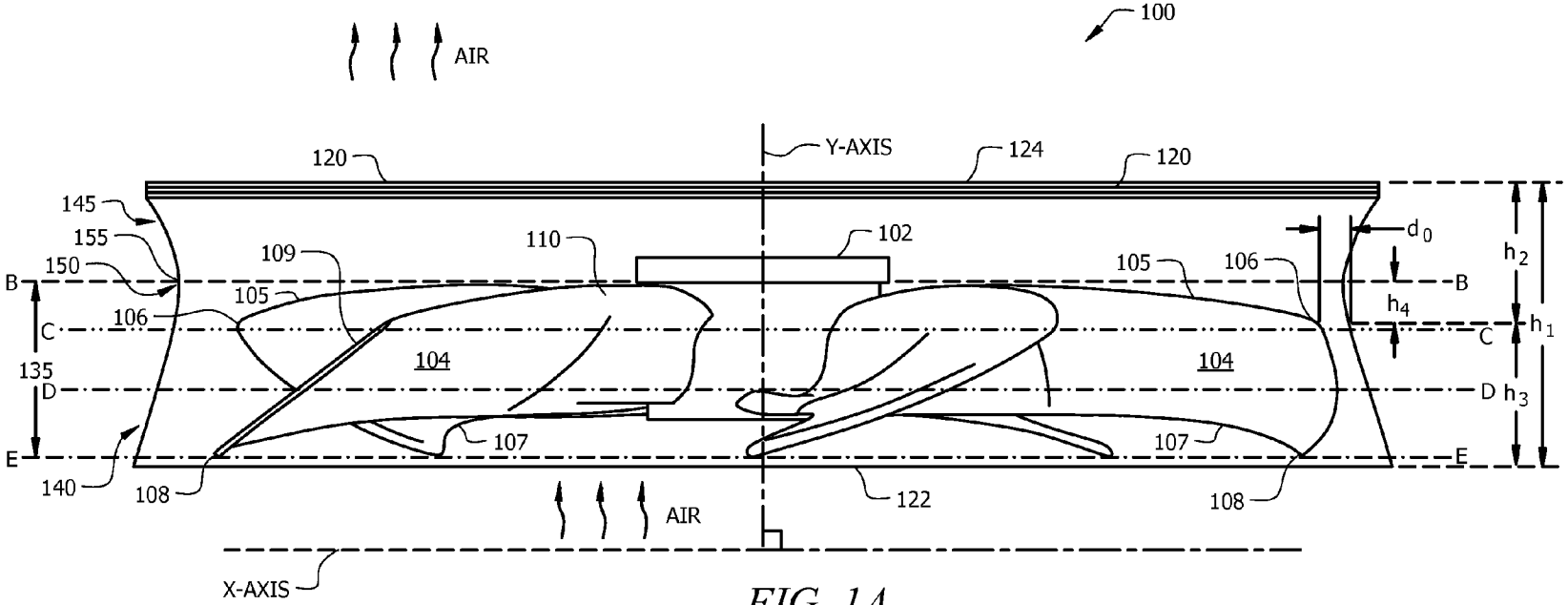
FIG. 1A illustrates a cutaway side view of an implementation of an example fan system.
Figure 2A:
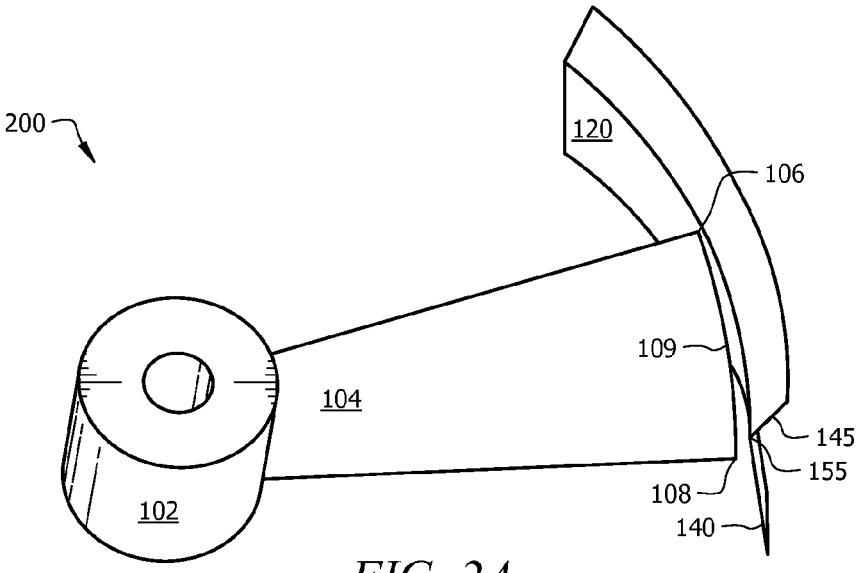
FIG. 2A illustrates a cutaway isometric side view of an implementation of an example portion of a fan system.

FIG. 1A illustrates a cutaway side view of an implementation of an example fan system 100. FIG. 2A illustrates a cutaway isometric side view of a portion of an example fan system 200. The fan systems 100, 200 each include a fan 110, a motor (not shown), and an orifice 120. The fan 110 may include a central hub 102 that couples one or more blades 104 of the fan. The blades 104 may rotate about an axis of rotation that is parallel to a length of the hub 102 (e.g., y-axis in FIG. 1A). A plane of rotation may be normal to the axis of rotation (e.g., a plane of rotation may include the x-axis illustrated in FIG. 1A and a z-axis (not shown), which is perpendicular to the x-axis and the y-axis).

The blades 104 may have a trapezoidal shape, a rectangular shape, a triangular shape, or any other appropriate shape. The blades 104 may include curved portions and/or planar portions. The fan 110 may include at least one blade 104. In some implementations, at least a portion of the edge 109 of a blade 104 (e.g., disposed proximate an end of the blade 104) may be curved, straight, and/or approximately parallel to the hub 102 (e.g., parallel to the y-axis), such as the edge 109 of the blade 104.

The hub 102 may be proximate a center of the fan 110. A blade 104 may be coupled at a first end to the hub 102 and the opposing second end of the blade 104 may be proximate an end of the fan 110.

The fan 110 may include a trailing edge 105 and a leading edge 107. The leading edge 107 may contact a stream of air first during operation and the trailing edge 105 may contact the same stream of air after the leading edge 107. The trailing edge 105 and the leading edge 107 may be at least partially symmetric and/or different. The fan 110 may include a top tip 106 and a bottom tip 108 proximate an end of the fan 110 and/or proximate an end of the blade 104 (e.g., the second end of the blade 104 opposed to the first end of the blade 104 coupled to the hub 102). The top tip 106 may be disposed proximate a trailing edge 105 of a blade 104 of a fan 110. For example, the top tip 106 may be a top point of a blade 104 and/or proximate to the top point of the blade 104. The bottom tip 108 may be disposed proximate a leading edge 107 of a blade 104 of a fan 110. For example, the bottom tip 108 may be a bottom point of a blade 104 and/or proximate the bottom point of the blade 104. An edge 109 of the fan 110 may be disposed proximate the end of the fan 110 and/or the edge 109 may extend between the top tip 106 and the bottom tip 108.

Figure 1B:
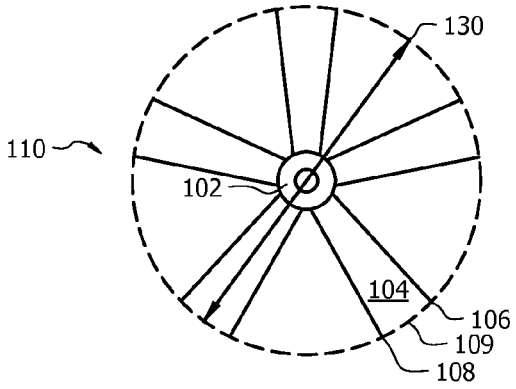
FIG. 1B illustrates a top view of an implementation of an example fan system.

As illustrated in FIG. 1B, a fan 110 may have a fan diameter 130. The fan diameter 130 may be approximately 20-30 inches in diameter, in some implementations. The fan 110 may be an approximately 26-inch diameter fan. The fan 110 may include a fan diameter 130 of approximately 26.18 inches, for example.

The fan 110 may have a fan height 135, as illustrated in FIG. 1A. The fan height 135 may be the maximum distance along the y-axis between the leading edge 107 and the trailing edge 105 (e.g., a distance along the y-axis between the bottom tip 108 and a farthest point on the trailing edge 105, such as a point on a curvature of the trailing edge 105). The fan height 135 may be the distance along a y-axis between a top tip 106 and a bottom tip 108 of a blade 104 of a fan 110, in some implementations. The fan height 135 may be approximately 2.5 inches to approximately 4 inches. For example, the fan height 135 may be approximately 3.36 inches.

The fan 110 may be coupled to a motor (not shown). Any appropriate motor may be utilized. The motor may be coupled to the central hub 102 of the fan 110. The motor may cause rotation of the blades 104 about an axis parallel to the central hub 102 of the fan 110 (e.g., y-axis illustrated in FIG. 1A).

Figure 3:
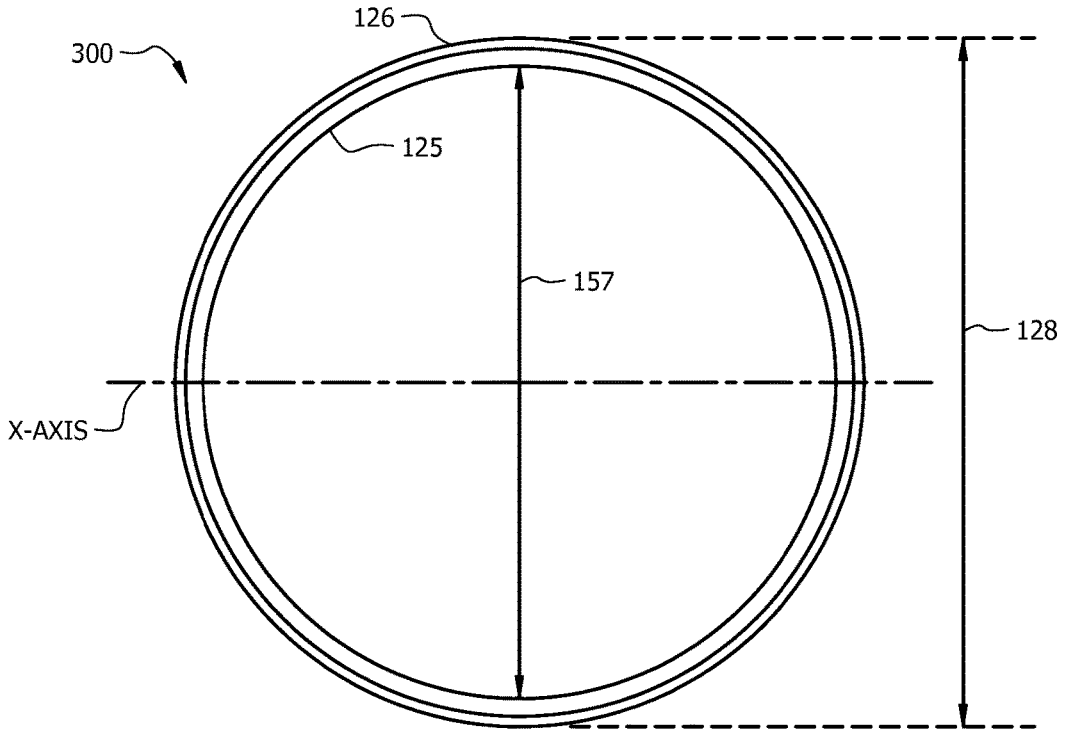
FIG. 3 illustrates a top view of an implementation of an example orifice.
Figure 4:
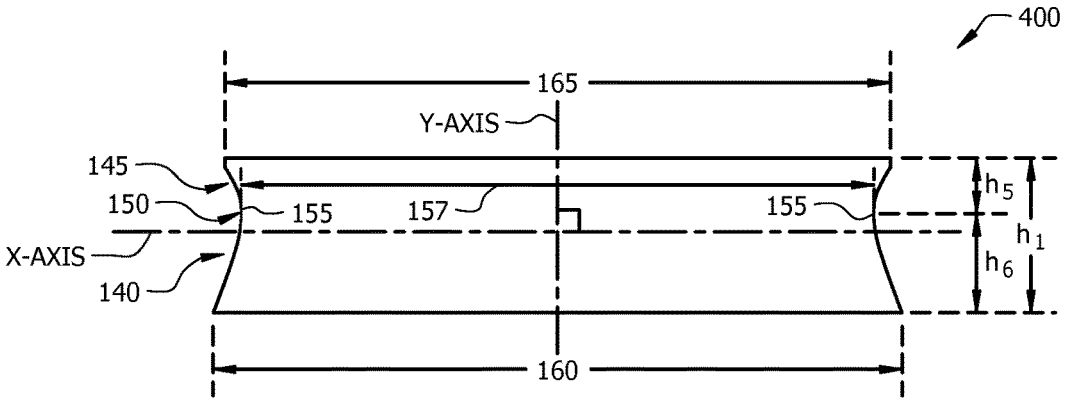
FIG. 4 illustrates an implementation of a portion of an example fan system.

The fan 110 may be disposed at least partially within the orifice 120. FIG. 3 illustrates a top view of an implementation of an example body 300 of an orifice 120. FIG. 4 illustrates a side view of an implementation of an example body 400 of an orifice 120.

As illustrated in FIGS. 1A-4, the orifice 120 may include a body 300, 400 in which the fan 110 is disposed. The body 300, 400 of the orifice 120 may include plastic and/or aluminum, for example. The body 300, 400 may include an opening disposed through the orifice 120. At least a portion of air may flow though the opening in the orifice 120 in a direction parallel to the y-axis, illustrated in FIGS. 1A and 4.

The body 300, 400 may include an inner surface 125 and an outer surface 126. The inner surface 125 may contact the air flowing through the orifice 120 and generated by the fan 110. Since the inner surface 125 of the body 300 contacts air flowing through the orifice 120, the inner surface 125 may include sloping portions to ease a transition of air from a larger diameter portion of the orifice 120 to a smaller diameter portion of the orifice (e.g., to decrease turbulence cause by air interacting with a wall of the inner surface). The inner surface 125 and the outer surface 126 may have similar shapes and/or different shapes.

The cross-sectional shape of the orifice 120, in the x-axis plane or the plane of rotation, and/or of the inner surface 125 and/or outer surface 126 may be any appropriate shape. As illustrated in FIG. 3, the cross-sectional shape of the orifice 120 in the x-axis plane of the inner surface 125 and/or the outer surface 126 may be circular.

The outer surface 126 may have a maximum outer surface diameter 128. For example, the outer surface 126 may have a maximum outer surface diameter 128 of approximately 28.9 inches. The maximum outer surface diameter 128 may be disposed proximate the bottom surface 122 of the orifice 120. In some implementations, the inner surface diameter 165 proximate a top surface 124 of the orifice 120 may have a dimension that is less than or approximately equal to the maximum outer surface diameter 128. For example, the inner surface diameter 165 proximate the top surface 124 of the orifice 120 may be approximately 28.3 inches to approximately 28.4 inches.

In some implementations, the inner surface 125 of the orifice 120 may vary in diameter along a y-axis that is parallel to the direction of air flow through the orifice 120 (e.g., the diameter may vary along the orifice height h1). For example, the inner surface 125 and/or outer surface 126 may include one or more curved portions. The inner surface 125 of the orifice 120 may have a smooth slope (e.g., as opposed to sharp changes in diameter) to decrease air flow turbulence due to the orifice shape.

The orifice 120 may include a converging section 140, a diverging section 145, and a minimum radius section 150 disposed between the converging section 140 and the diverging section 145. For example, at least a portion of the orifice 120 may include a similar shape to a hyperbolic paraboloid.

Figure 2B:
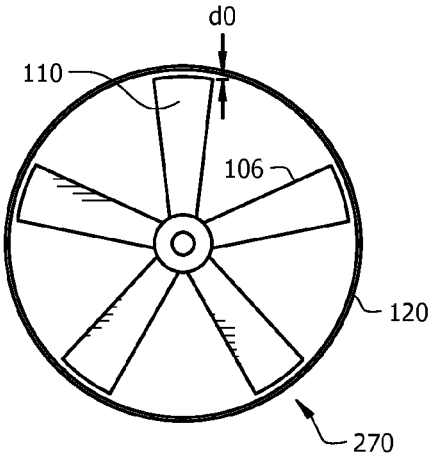
FIG. 2B illustrates a cutaway top view of a portion of a fan system, taken along section line B-B of FIG. 1A.
Figure 2C:
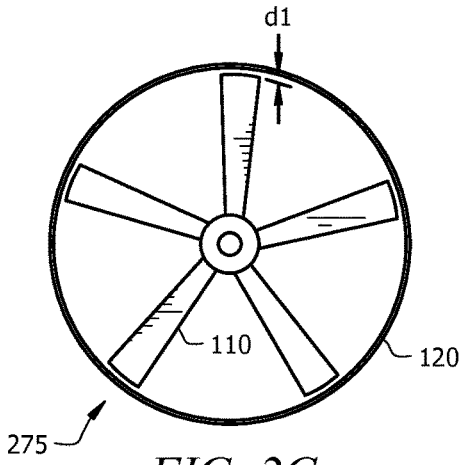
FIG. 2C illustrates a cutaway top view of a portion of a fan system, taken along section line C-C of FIG. 1A.
Figure 2D:
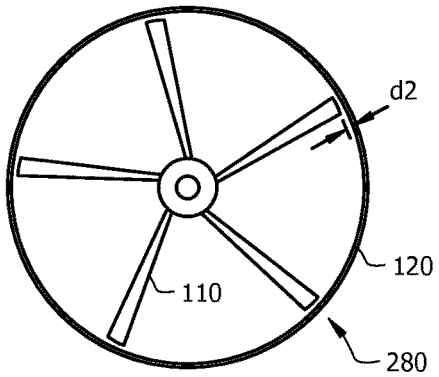
FIG. 2D illustrates a cutaway top view of a portion of a fan system, taken along section line D-D of FIG. 1A.
Figure 2E:
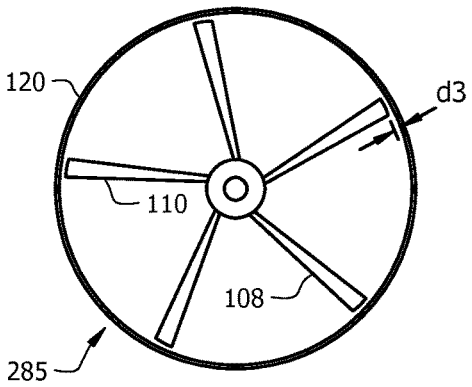
FIG. 2E illustrates a cutaway top view of a portion of a fan system, taken along section line E-E of FIG. 1A.

FIGS. 2B-2E illustrate cutaway top views of different portions of the implementation of the fan system of FIG. 1A. In some implementations, the configuration of orifice 120 may be such that a first clearance d0 (e.g., a distance along an x-axis between a part of the fan and a part of the inner surface) proximate a top surface of a fan 110 disposed in the orifice 120 may be less than a second clearance d3 proximate a bottom surface of the fan 110, as illustrated in FIGS. 2B and 2E. In some implementations, performance of the fan system (e.g., leaky air flow characteristics, such as backflow and/or turbulence) may not be reduced when compared to a fan system in which a uniform clearance is maintained proximate the fan edge.

In some implementations, the converging section 140 may be proximate a bottom surface 122 of the orifice 120. The converging section 140 may extend from a bottom surface 122 to and/or proximate to the minimum radius section 150. The converging section 140 may be disposed proximate an edge 109 of a blade 104 of a fan 110. The converging section 140 may include sloped portions (e.g., linearly sloped and/or curved and sloped). A bottom inner surface diameter 160 may be disposed proximate an end of the converging section 140 that is opposed to the end of the converging section proximate the minimum radius section 150. The bottom inner surface diameter 160 may comprise the maximum inner diameter for the inner surface 125. At least a portion of the converging section 140 may slope from the bottom inner surface diameter 160 to a minimum diameter 157 of the minimum radius section 150 (e.g., diameter at minimum diameter point 155).

The diverging section 145 may be proximate a top surface 124 of the orifice 120. The diverging section 145 may extend from a top surface 124 to and/or proximate to the minimum radius section 150. The diverging section 145 may include sloped portions (e.g., linearly sloped and/or curved and sloped). A top inner surface diameter 165 may be less than and/or equal to the bottom inner surface diameter 160, in some implementations. The top inner surface diameter 165 may be greater than the minimum diameter 157. At least a portion of the diverging section 145 may slope from the minimum diameter 157 of the minimum radius section 150 to the top inner surface diameter 165, in some implementations.

The minimum radius section 150 may include a minimum diameter point 155 disposed on the inner surface 125 of the orifice 120. The minimum diameter point 155 may be a portion of the inner surface 125 with the smallest diameter (e.g., minimum diameter 157) relative to the rest of the orifice 120. For example, the minimum diameter point 155 may be on and/or proximate to the circumference of the inner surface 125 associated with the minimum diameter 157. In some implementations, the minimum diameter 157 may be approximately 26.62 inches.

The orifice 120 may have a height, $h_1$. The orifice height, $h_1$, may be the distance along a y-axis between a top surface 124 of the orifice 120 and a bottom surface 122 of the orifice. The orifice height, $h_1$, may be approximately 6 inches to approximately 7 inches. For example, the orifice height, $h_1$, may be approximately 6.5 inches.

In some implementations, a fan 110 may be disposed in the orifice 120 at a predetermined position to control the properties of the airflow during use (e g, inhibit leaky orifice behavior, inhibit turbulence). The top surface of the fan 110 (e.g., top tip 106) may be disposed at a height, $h_2$, from the top surface 124 of the orifice 120. For example, the height, $h_2$, may be approximately 3 inches to approximately 3.5 inches from the top surface 124 of the orifice 120.

The top surface of the fan 110 (e.g., top tip 106) may be disposed at a height, $h_3$, from the bottom surface 122 of the orifice 120. For example, the height, $h_3$, may be approximately 0.085 times the fan height 135 to approximately 0.095 times the fan height 135 from the bottom surface 122 of the orifice 120. In some implementations, the height, $h_3$, for a fan 110 with a 26-inch diameter may be approximately 3.36 inches.

In some implementations, the top tip 106 of the fan 110 may be disposed at a height, $h_4$, from the minimum diameter point 155 and/or minimum radius section 150. For example, the height, $h_4$, may be approximately 0.095 times the fan height 135 to approximately 0.015 times the fan height 135. In some implementations, a height, $h_4$, may be approximately 0.9 inches.

In some implementations, the diverging section 145 of the orifice 120 may be disposed in a part of the orifice 120 with a height, $h_5$. The height, $h_5$, may be the distance, along a y-axis, from an area proximate the top surface 124 of the orifice 120 to an area proximate the minimum diameter point 155. For example, a height, $h_5$, may be approximately 2.24 inches for a 26-inch diameter fan.

In some implementations, the converging section 140 of the orifice 120 may be disposed in a part of the orifice 120 with a height, $h_6$. The height, $h_6$, may be the distance along a y-axis from an area proximate a bottom surface 122 of the orifice 120 to an area proximate the minimum diameter point 155. For example, the height, $h_6$, may be approximately 4.26 inches for a 26-inch diameter fan.

In some implementations, the clearance (e.g., distance along the x-axis) between an edge 109 proximate an end of a blade 104 (e.g., the second end opposite the first end coupled to the central hub 102) of the fan 110 and at least a portion of the inner surface 125 of the orifice 120 may not be uniform, as illustrated in FIG. 2A. A clearance may be a horizontal distance (e.g., a distance along a x-axis) between two points or parts, such as between a point on the edge 109 of the blade 104 and a point on the inner surface 125. The clearance may be a distance along the x-axis between a part of the fan 110 and a part of the inner surface 125 of the orifice 120, in some implementations. During use of the fan system, airflow may be disposed in the clearance and flow towards the top of the orifice 120 by the flow created by the rotating fan 110.

Utilizing a nonuniform clearance (e.g., when the distance between the edge 109 and the inner surface 125 varies along a height of the edge 109) between the fan edge and a surface of the orifice 120 may at least partially reduce and/or at least partially inhibit ice bridging between the fan blades 104 and the orifice 120. For example, ice may accumulate as an ice bridge between an area proximate the minimum diameter point 155 and proximate the top tip 106. The ice bridge may be thin (e.g., when compared to an ice bridge formed in an approximately uniform clearance system) and may easily break (e.g., when torque from the rotation of the fan 110 is provided). In some implementations, the ice accumulation, such as an ice bridge, may be thin and may be easily reduced using a defrost cycle (e.g., for air conditioner and/or other heat pump applications). Utilizing a non-uniform clearance with a fan system may not substantially decrease fan performance properties (e.g., turbulence, fan speed, energy efficiency, and/or power) when compared with a fan system with a uniform clearance and a similar sized minimum clearance to the minimum clearance in the nonuniform clearance fan system.

As illustrated in FIGS. 1A and 2B-2E, a clearance (e.g., distances $d_0$, $d_1$, $d_2$, and/or $d_3$, along the x-axis) may exist between an edge 109 of a fan 110 and a part of the inner surface 125 of the orifice 120. As best illustrated in FIG. 1A, and also visible from the top view in FIG. 2B, a minimum clearance, $d_0$, may include the distance along the x-axis between a blade 104 of the fan 110 (e.g., top tip 106) and a minimum radius section 150 and/or minimum radius point 155. In some implementations, a minimum clearance $d_0$ may be approximately 0.0075 times the fan diameter 130 to approximately 0.0125 times the fan diameter 130. The minimum clearance $d_0$ may be approximately 0 to approximately 0.3 inches. For example, the minimum clearance $d_0$ may be approximately 0.32 inches for a 26-inch diameter fan.

As illustrated in FIG. 2E, a maximum clearance, $d_3$, may include the distance between a bottom tip 108 and a portion of the inner surface 125 of the orifice 120. The maximum clearance, $d_3$, may include the distance along the x-axis between the bottom tip 108 and a portion of the inner surface 125 normal to the bottom tip 108. The maximum clearance, $d_3$, may be approximately 0.04 times the fan diameter 130 to approximately 0.05 times the fan diameter 130. For example, a maximum clearance $d_3$ may be approximately 1.17 inches for a 26-inch diameter fan.

As illustrated in FIGS. 2B-2E, a nonuniform clearance fan system may include varying clearances. For example, distances $d_1$, illustrated in FIG. 2C, and $d_2$, illustrated in FIG. 2D, may not be similar. In addition, $d_0$, illustrated in FIG. 2B, may not be similar to $d_1$, $d_2$, and/or $d_3$, illustrated in FIG. 2E. In some implementations, the clearance, or distance along the x-axis, between the edge 109 of the blade 104 and the converging section 140 varies across an orifice height and/or a fan height 135 in a nonuniform clearance fan system. The converging section 140 may have a slope of approximately $d_3$-$d_0$/($h_3$+$h_4$), in some implementations.

In some implementations, the components of the fan system may be selected based on, for example, the application in which the fan may be utilized. For example, a heat pump in a 5-ton air conditioning unit may utilize a 26-inch diameter fan having an orifice with diameters from approximately 26.6 inches to approximately 29 inches. In some implementations, a fan orifice may be selected with a minimum tip clearance of approximately 0.0075 times the fan diameter to approximately 0.0125 times the fan diameter. In some implementations, a fan and a fan orifice may be selected such that a nonuniform clearance is provided between an edge of the fan and the inner surface of the orifice proximate the edge of the fan.

The selected components may be coupled. For example, the motor may be coupled to the fan. The fan may be disposed at least partially in the orifice at one or more predetermined positions. For example, the fan may be disposed in the orifice such that a distance along a y-axis from a top tip of the fan to the bottom of the orifice may be approximately 0.85 times the fan height to approximately 0.95 times the fan height. In some implementations, the fan may be disposed in the orifice such that a distance along a y-axis from a top tip of the fan to the orifice minimum radius section and/or minimum diameter point may be approximately 0.05 times the fan height to approximately 0.15 times the fan height.

The fan system may be coupled to at least a portion of an air conditioner (e.g., in a housing of an outdoor coil). The air conditioner may be allowed to operate utilizing the fan system.

In some implementations, the air conditioner may be allowed to operate in conditions favorable for ice accumulation (e.g., moist and/or cold environment). Ice may accumulate on portions of the air conditioner (e.g., outdoor coil). Ice may accumulate on surfaces of the fan orifice. In some implementations, ice may accumulate on the fan.

Ice accumulation may be reduced. The nonuniform clearance of the fan system may inhibit ice bridge formation. For example, an ice bridge may form between a minimum radius section and a top tip, and the rotation of the fan may inhibit and/or break the ice bridge. One or more defrost operations may be allowed during ice conditions to reduce ice accumulation (e.g., reversing valve may be energized and/or de-energized to heat the outdoor coil).

Although fan systems in heat pump air conditioning systems have been described, the fan systems may be utilized in other appropriate applications, such as other air conditioning systems and/or refrigeration systems.

A diameter has been described in various implementations. A diameter may be the greatest distance between any two points on a circumference of the area of the path of spinning fan. For example, the diameter may be a width of a circle and/or a width of a major axis of an ellipse.

Although certain fan shapes are illustrated, other fan shapes and/or configurations may be utilized as appropriate.

In various implementations, references to a top, a side, and/or a bottom are to indicate relative locations and not orientation in an application. For example, the top surface of the fan may be oriented in a sideways manner in a heat pump. In some implementations, the bottom surface of the fan may be oriented towards the top of a unit containing the fan system.

It is to be understood that the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "fan" includes a combination of two or more fans and reference to "blade" includes different types and/or combinations of blades. As another example, "coupling" includes direct and/or indirect coupling of members.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A fan system comprising:

an orifice having an inner surface, the inner surface comprising:

a converging section;

a diverging section; and a minimum radius section disposed between the converging section and the diverging section;

a fan disposed at least partially in the fan orifice, the fan comprising:

a top tip;

a bottom tip;

a curved edge between the top tip and the bottom tip; and a fan diameter;

a minimum clearance comprising a first radial distance between a portion of the minimum radius section of the inner surface of the orifice and the top tip of the fan, wherein the minimum clearance is approximately 0.0075 times the fan diameter to approximately 0.0125 times the fan diameter; and a maximum clearance comprising a second radial distance between a portion of the converging section of the inner surface of the orifice and the bottom tip of the fan, wherein the maximum clearance is approximately 0.04 times the fan diameter to approximately 0.05 times the fan diameter;

wherein an axial distance between the top tip of the fan and a bottom of the orifice is approximately 0.85 times the fan height to approximately 0.95 times a fan height.

2. The fan system of claim 1 wherein the orifice further comprises an outer surface with an approximately similar shape to the inner surface.

3. The fan system of claim 1 wherein an axial distance between the top tip of the fan and the minimum radius section is approximately 0 to approximately 0.3 times a fan height.

4. The fan system of claim 1 wherein at least a portion of the diverging section of the orifice slopes, and wherein at least a portion of the converging section of the orifice slopes.

5. A fan system comprising:

an orifice having an inner surface, the inner surface comprising:

a converging section disposed proximate a bottom of the orifice;

a diverging section; and a minimum radius section disposed between the converging section and the diverging section, wherein the minimum radius section comprises a minimum diameter point; and a fan comprising:

a top tip;

a bottom tip at a different radius than the top tip; and a fan height comprising the distance between the top tip and the bottom tip;

wherein the fan is disposed in the orifice such that an axial distance between the top tip of the fan and the minimum diameter point is approximately 0 to approximately 0.3 times the fan height and wherein the fan is disposed in the orifice such that the top tip is approximately 0.85 times the fan height to approximately 0.95 times the fan height from the bottom of the orifice along the axial direction.

6. The fan system of claim 5 wherein the orifice further comprises an outer surface, and wherein at least a portion of the outer surface comprises an approximately similar shape to at least a portion of the inner surface.

7. The fan system of claim 5 further comprising a minimum clearance comprising a radial distance between at least a portion of the minimum radius section of the inner surface of the orifice and the top tip of the fan, wherein the minimum clearance is approximately 0.0075 times a fan diameter to approximately 0.0125 times the fan diameter.

8. The fan system of claim 5 further comprising a maximum clearance comprising a radial distance between at least a portion of the converging section of the inner surface of the orifice and the bottom tip of the fan, wherein the maximum clearance is approximately 0.04 times a fan diameter to approximately 0.05 times the fan diameter.

9. A fan system comprising:

an orifice having an inner surface, the inner surface comprising:

a converging section;

a diverging section; and a minimum radius section disposed between the converging section and the diverging section;

a fan disposed in the fan orifice such that a first clearance between a top tip of the fan and a first part of the inner surface of the orifice is less than a second clearance between a bottom tip of the fan and a second part of the inner surface of the orifice, wherein the top tip and the bottom tip are joined by a curved edge, and wherein the fan is disposed in the orifice such that the top tip is approximately 0.85 times a fan height to approximately 0.95 times the fan height from a bottom of the orifice along the axial direction.

10. The fan system of claim 9 further comprising:

a minimum clearance comprising a radial distance between at least a portion of the minimum radius section of the inner surface of the orifice and the top tip of the fan, wherein the minimum clearance is approximately 0 to approximately 0.0125 times the fan diameter.

11. The fan system of claim 9 further comprising:

a maximum clearance comprising a radial distance between at least a portion of the converging section of the inner surface of the orifice and the bottom tip of the fan, wherein the maximum clearance is approximately 0.04 times a fan diameter to approximately 0.05 times the fan diameter.

12. The fan system of claim 9 wherein the converging section comprises:

a first end proximate a bottom of the orifice; and a second end proximate the minimum radius section;

wherein the first end is approximately 0.04 times a fan diameter to approximately 0.05 times the fan diameter from the bottom tip of the fan along a radial direction; and wherein the top tip of the fan is approximately 0 to approximately 0.3 times a fan height along the axial direction from a minimum diameter point of the minimum radius section of the inner surface of the orifice.

13. The fan system of claim 12 wherein the converging section slopes from the first end to the second end.

14. The fan system of claim 9 wherein at least a portion of the converging section comprises a linearly sloped part, and wherein at least a portion of the diverging section comprises a linearly sloped part.

15. The fan system of claim 9 wherein a radius of the orifice proximate a top end of the orifice is less than a radius of the orifice proximate a bottom end of the orifice.

16. The fan system of claim 9 wherein the fan orifice comprises an approximately circular cross-section.

* * * * *